US005768878A

United States Patent [19]

Stahlecker

[11] Patent Number: 5,768,878

[45] Date of Patent: Jun. 23, 1998

[54] OPEN-END SPINNING PROCESS AND APPARATUS FOR PERFORMING SAME

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Süssen, both of Germany

[21] Appl. No.: 774,302

[22] Filed: Dec. 24, 1996

[30] Foreign Application Priority Data

Jan. 13, 1996 [DE] Germany ..... 196 01 038.1

[51] Int. Cl.[6] ..... D01H 4/00

[52] U.S. Cl. ..... 57/401; 57/403

[58] Field of Search ..... 57/401, 403, 408, 57/411–413, 328, 333; 19/150

[56] References Cited

U.S. PATENT DOCUMENTS

| | | | |
|---|---|---|---|
| 4,237,685 | 12/1980 | Pelagio et al. | 19/150 X |
| 4,672,800 | 6/1987 | Fehrer | 57/401 X |
| 4,676,062 | 6/1987 | Brockmanns et al. | 57/401 X |
| 4,697,411 | 10/1987 | Artzt et al. | 57/401 |
| 4,718,227 | 1/1988 | Handschuch | 57/401 |
| 4,745,738 | 5/1988 | Stahlecker | 57/401 X |
| 4,860,530 | 8/1989 | Montgomery et al. | 57/401 X |

FOREIGN PATENT DOCUMENTS

| | | |
|---|---|---|
| 4040102 | 6/1992 | Germany . |
| 4040102A1 | 6/1992 | Germany . |
| 3-152223 | 6/1991 | Japan . |

*Primary Examiner*—C. D. Crowder
*Assistant Examiner*—Tina R. Taylor
*Attorney, Agent, or Firm*—Evenson McKeown Edwards & Lenahan, PLLC

[57] ABSTRACT

In a process in open-end spinning at least one sliver is opened into single fibers. A collecting surface, rotating at a higher speed than the opened single fibers takes up these as soon as they have left the opening area. The single fibers are taken along by the collecting surface while being expanded transversely to the rotational direction of the collecting surface in the form of a fiber veil. Before the completion of one revolution of the collecting surface, the single fibers are withdrawn from the collecting surface along a collecting line under an imparted twist thus forming a yarn, namely transversely to the direction of rotation of the collecting surface. The withdrawal speed corresponds hereby at least to the arrival speed of the single fibers at the collecting line.

10 Claims, 4 Drawing Sheets

OPEN-END SPINNING PROCESS AND APPARATUS FOR PERFORMING SAME

BACKGROUND AND SUMMARY OF THE INVENTION

The present invention relates to a process in open-end spinning, in which at least one sliver is opened into single fibers, which are taken up in the form of a fiber veil expanded transversely to the direction of rotation by a collecting surface rotating at a higher speed than the speed of the arriving single fibers. Before completion of one revolution of the collecting surface, the fiber veil is withdrawn under the action of an imparted twist, thus forming a yarn along a collecting line at a withdrawal speed which corresponds at least to the arrival speed of the single fibers at the collecting line.

In the case of a prior art arrangement (German published patent application 40 40 102), a plurality of slivers adjacent to each other are fed to an opening roller. The opened single fibers are taken up by a rotating collecting surface preferably in the form of a disc, whose speed corresponds at least to the feeding speed of the fibers. The collected single fibers, in the form of a fiber veil expanded transversely to the direction of rotation, are bundled during one revolution of the disc by being forced to form a line. The thus formed yarn is then withdrawn in the transport direction of the disc, whereby the yarn is imparted a twist by means of an air nozzle. The withdrawal speed is greater than the rotational speed of the disc.

The known process has the advantage that the single fibers never lose speed during the spinning process, so that a crinkling of the single fibers does not occur at any point. The feeding speed of the single fibers onto the collecting surface is however inevitably so great that the withdrawal speed reaches an order of magnitude where it is scarcely controllable. In addition, any doubling present in the fiber veil is lost through bundling of the single fibers on the collecting surface.

It is an object of the present invention to avoid the disadvantages of the present process and to create a process whereby the opened single fibers do not loose speed at any time, while maintaining a controllable withdrawal speed and a certain degree of doubling effect.

This object has been achieved in accordance with the present invention in that the single fibers are taken up by the collecting surface directly after the sliver has been opened, and that the collecting line extends transversely to the direction of rotation.

As in the above mentioned prior art, the advantage that the single fibers are never crinkled during the entire spinning process, but indeed are ideally continuously accelerated, is maintained. Nevertheless, the arrival speed of the single fibers at the collecting surface is not too high, as the single fibers are taken up by the collecting surface before they are accelerated too much by the opening device. Due to the formation of the fiber veil a good parallel position of the single fibers is maintained in the yarn. A so-called lateral open fiber formation arises, which comprises as many or more fibers than the finished yarn. Because the collecting line extends transversely to the rotational direction of the collecting surface, an axial staggering of the single fibers arises during spinning of the yarn, which lessens to a large extent drafting defects caused by the opening device. Due to this longitudinal staggering of the single fibers arriving at the collecting line, the single fibers are twisted to varying degrees. In the core of the yarn there arises a harder twist, while on the outside of the yarn there is a softer twist. Due to the predetermined width of the fiber veil, the varying twists in the core and on the outside of the yarn can be pre-set.

It is known from Japanese published patent application 3-152223 to arrange a suction roller downstream of an opening roller and to feed the opened single fibers to a collecting line, from where they are withdrawn transversely to the rotational direction of the suction roller. There are however no speeds given in the publication, so that it is not quite evident why the suction roller is arranged relatively near to the opening roller. The opening roller releases a stream of fibers without the presence of a normal feeding device. Thus it is not clear how the yarn fineness can be determined by a ratio between feeding speed and withdrawal speed. The single fibers reaching the collecting line are nipped by a friction belt, so that withdrawal of the forming yarn is made more difficult.

Advantageously, the single fibers of a plurality of slivers are fed to the collecting line. Hereby can not only coarser yarns be spun, but also a greater axial staggering arises along the collecting line, whereby any possible irregularities in the yarn evenness are further lessened. It is possible to feed slivers of varying fineness and if required to leave a slight space between two slivers. In this way, different fibers can be spun into the core and into the outside of the yarn.

In preferred embodiments of the invention, the imparted twist takes places in two subsequent stages, whereby the collecting surface is involved in the first "slip" stage.

Various embodiments are contemplated, according to whatever degree the collecting surface is involved in the imparted twist and according to whether the yarn first receives its complete twist after it has left the collecting surface.

The collecting surface cannot only collect the yarn, it can also practically impart the entire twist to the yarn. The collecting surface may however simply collect the single fibers in a pre-consolidation phase, whereby the actual imparting of the twist is done by a twist inserter arranged downstream. Alternatively, the collecting surface can collect the single fibers and generate a certain amount of twist, whereby, with the aid of a further twist inserter, the twisting process is completed. The separate twist inserter, however, can also be used simply to subsequently act on the already twisted yarn and to complete the twist, so that hairiness is reduced. If required, a separate yarn filament can even be added in the case of this spinning process.

In the case of a device for carrying out the process, a transport roller is provided which is arranged parallel to the axis of an opening roller and which rotates in the opposite direction thereto, the peripheral surface of the transport roller being formed as a collecting surface and extending to close proximity of the opening area, whereby the peripheral surface, in the area of the collecting line, is a component of a twist device which effects a twist. The collecting line is still located on the collecting surface, which in turn participates at least partly in imparting a twist.

The transport roller is advantageously provided with a porous peripheral surface which is suctioned from the inside essentially from the opening area to the collecting line. The speed of the single fibers from the opening area to the collecting line is thus controlled. If necessary, the single fibers can already lie on the transport roller before they finally leave the fiber beard, which is combed out by the opening roller. The degree to which the fibers cling to the collecting surface can be regulated by the suction.

It is practical to arrange a friction roller belonging to the twist device near the transport roller in the area of the collecting line, but at a distance thereto. Thus a wedge-shaped gap arises in the area of the collecting line, as is known in friction spinning. A twist inserter, preferably in the form of a twist nozzle and belonging to the twist device, is advantageously arranged at an axial distance to the transport roller in extension of the collecting line. The collecting surface is involved to a certain degree in imparting a twist, while the final twist is present after the yarn has run through the twist inserter arranged downstream. The arrangement of the intensities of the collecting surface and the twist inserter arranged downstream thereof can be used, in respect to imparting a twist, to spin different types of yarn.

In a particularly advantageous embodiment of the invention, the width of the opening roller is designed for a plurality of adjacent slivers, which are guided together before they reach the opening roller. This leads not only to a greater staggering of the single fibers along the collecting line, but also permits variation in the yarn fineness. As the single fibers are continuously accelerated, the fiber veil which arises during opening contains at least already the same number of single fibers as the finished yarn.

Practically, the width of the transport roller is greater than the width of the opening roller. The fiber veil is thus expanded a little more along the collecting line. In a further embodiment, pneumatic means for transferring the single fibers to the transport roller are arranged to the opening roller. Thus it is ensured that the single fibers leave the opening roller while still in the opening area before they are accelerated too much.

In a further embodiment, a guiding roller, arranged upstream of the collecting line and forming a guiding gap with the collecting surface, is arranged to the transport roller. Such a guiding roller helps to keep the single fibers, guided to the collecting line, held securely on the collecting surface, and if necessary, to even out the fiber veil.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
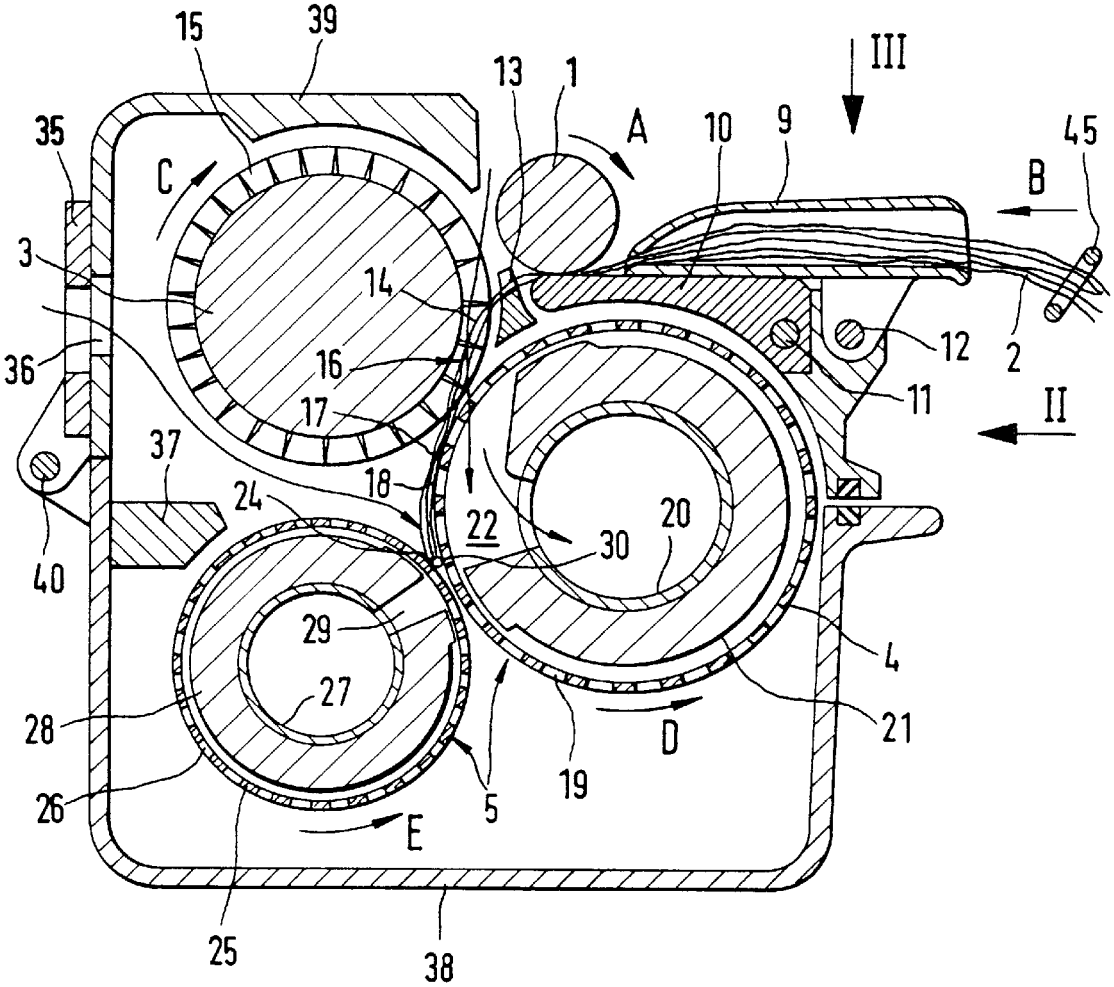
FIG. 1 is a schematic sectional side view of a device constructed according to a preferred embodiment of the present invention, comprising an opening roller, a suction roller arranged very closely to the opening roller and a suctioned friction roller arranged close to the suction roller.
Figure 2:
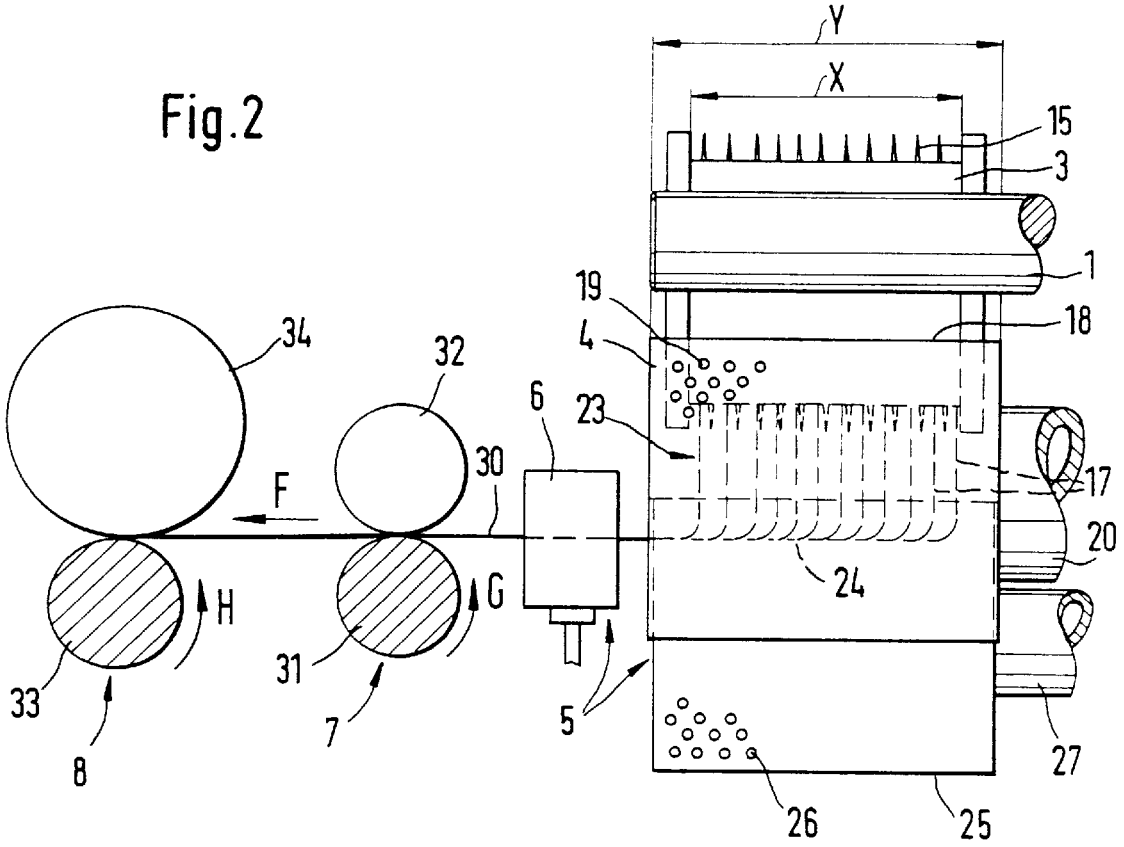
FIG. 2 is a view in the direction of arrow II of FIG. 1, whereby some components are omitted and whereby a pneumatic twist inserter as well as a withdrawal and a winding device are shown.
Figure 3:
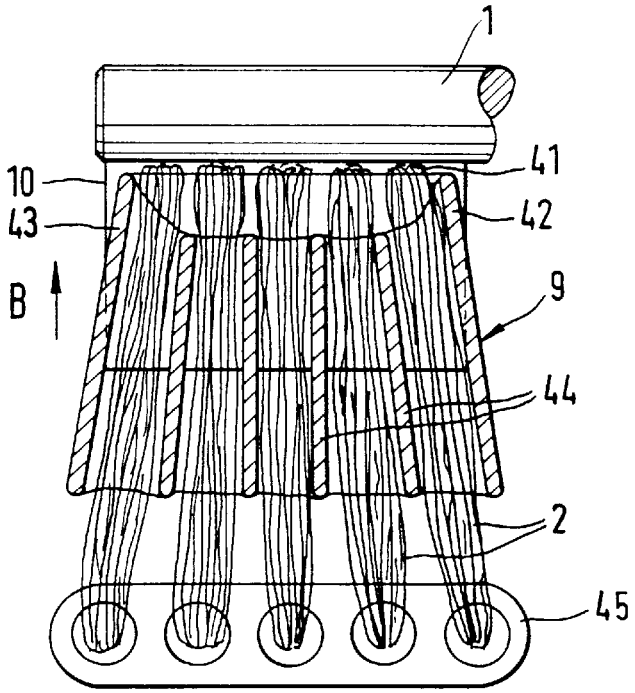
FIG. 3 is a view in the direction of arrow III of FIG. 1 onto the area of a feeding device arranged upstream of the opening roller.

The open-end spinning device according to FIGS. 1 to 3 essentially comprises the following components: a feed roller 1 for a plurality of slivers 2 to be spun, an opening roller 3, a transport roller 4, a twist device in its entirety denoted by 5 which comprises a twist inserter 6 arranged downstream thereof, a withdrawal device 7 and a winding device 8.

In the case of this spinning device, the slivers 2 should be spun into a yarn 30 in such a way that the single fibers 17 are not slowed down at any point, but rather, ideally, are constantly accelerated. In a way to be described below, the speeds between the feed roller 1, the opening roller 3, the transport roller 4 and the withdrawal device 7 are set accordingly.

The feed roller 1 with a larger width and driven in rotational direction A serves to feed a plurality of slivers 2 in the feed direction B. In a known manner, the slivers 2 are fed through a feed condenser 9, to be described below, into the nipping gap between the feed roller 1 and a feed table 10. The feed table 10 is pressed, spring mounted (not shown) against the feed roller 1, and can be swivelled around a stationary swivel axle 11. The feed condenser 9 can also be swivelled around a swivel axle 12, whereby during operation, the feed condenser 9 is disposed on the feed table 10 from above.

Between the feed roller 1 and the opening roller 3, a stationary fiber beard support 13 is provided, which is provided with lateral guides for the very wide fiber beard 14. The rotational direction C of the opening roller 3 corresponds to the rotational direction A of the feed roller 1, the opening roller 3 however rotating at a significantly higher speed. The fitting 15 of the opening roller 3 combs the fiber beard 14 into single fibers 17 in an opening area 16.

The above mentioned transport roller 4 is arranged in close proximity and parallel to the axis of the opening roller 3. The rotational direction D of the transport roller 4 runs in the opposite direction to the rotational direction C of the opening roller 3. The peripheral surface of the transport roller 4 is formed as a collecting surface 18 for taking up the opened single fibers 17. The collecting surface 18 is arranged in direct proximity to the opening area 16.

In order that the single fibers 17 are held on the collecting surface 18 and transported by same, the peripheral surface of the transport roller 4 is perforated with a perforation 19, as is known in friction spinning. A suction pipe 20 is located inside the transport roller 4, on which suction pipe 20 the transport roller 4 is supported (not shown). The suction pipe 20 bears a sealing insert 21, which leaves a suction opening 22 free, which extends approximately from the opening area 16 to a collecting line 24 where the single fibers 17 are spun to a yarn 30.

As the single fibers 17 reach the collecting surface 18 already in the opening area 16, this prevents the single fibers 17 being accelerated too much by the opening roller 3.

When the single fibers 17 are taken over onto the collecting surface 18, a fiber veil 23 is formed which extends transversely to the rotational direction D of the transport roller 4. The collecting surface 18 rotates at a slightly higher speed than the speed of the single fibers 17 at the moment when they are taken up by the collecting surface 18. The reason lies in particular therein that the single fibers 17 are already taken up by the transport roller 4 before they are accelerated too much by the opening roller 3. The single fibers 17 are therefore already taken up on the collecting surface 18 before they reach a fiber feed channel, usually arranged downstream of an opening roller, which fiber feed channel however, is not present in this case.

Long before the collecting surface 18 of the transport roller 4 has completed a revolution, the single fibers 17 reach a collecting line 24, where the twist is imparted. The single fibers 17 should then be withdrawn as a yarn 30 along the collecting line 24 at a speed which corresponds at least to the arrival speed of the single fibers 17 onto the collecting line 24.

Because the single fibers 17 are disposed on the collecting surface 18 in the form of a fiber veil 23, they are staggered during spinning along the collecting line 24, which lessens any possible drafting defects caused by the opening process. The more slivers 2 are used, the greater the reduction of defects.

Although not absolutely necessary, a friction roller 25 is arranged in the area of the collecting line 24 adjacent the transport roller 4, which friction roller 25, together with the transport roller 4, forms a wedge-shaped gap as known from friction spinning. The wedge-shaped gap is preferably of such dimensions that the yarn 30, in a combined effect with the suction of the transport roller 4 and the friction roller 25, does not yet receive its final twist, but rather the final twist is imparted by the twist inserter 6 arranged downstream, which preferably takes the form of a twist nozzle. The friction roller 25 should not in any circumstances press the forming yarn 30 to the collecting line 24. The rotational direction E of the friction roller 25 is the same as the rotational direction D of the transport roller 4.

The peripheral surface of the friction roller 25 is also provided with a perforation 26. The friction roller 25 is supported on a suction tube 27, on which, in the inside of the friction roller 25, a sealing insert 28 is provided, which leaves a suction slit 29 free which is directed against the collecting line 24.

The collecting surface 18 can therefore preferably take part in imparting a twist to the yarn 30. As already mentioned above, with the combined effect of the collecting surface 18, the friction roller 25 and the twist inserter 6, which form together the twist device 5, various intensities of twist are possible. Whether the greater part of the twist impartation takes place in the wedge-shaped gap of the transport roller 4 and the friction roller 25, or whether it takes place later by means of the twist inserter 6, can be determined beforehand.

The resulting yarn 30 is withdrawn in yarn withdrawal direction F along the collecting line 24 by the withdrawal device 7. This comprises a bottom roller 31 driven in arrow direction G, on which bottom roller 31 a top roller 32 is disposed. A winding device 8 is arranged downstream of the withdrawal device 7, which winding device 8 consists of a winding roller 33 driven in rotational direction H, and a yarn traverse motion device (not shown). The package 34 held in winder holders (also not shown) rests on the winding roller 33.

The transport roller 4 is, as already mentioned above, not only intended for the transport of single fibers 17 to the collecting line 24, but also takes part in imparting a twist.

The fitting 15 of the opening roller 3 is so formed that it can be permeated by a flow of air. The object is to guarantee that all single fibers 17 are taken up by the fitting 15 already in the opening area 16 and given over to the transport roller 4. The fitting 15 comprises therefore preferably very long needles, which have neither a positive nor a negative angle to the circumference of the opening roller 3, and which are first and foremost more suited to combing out the fiber beard 14 and less for transporting the single fibers 17. In this respect, the aim is that the opening roller 3 differs from the usual opening rollers found in rotor spinning machines.

In order that the single fibers 17 can be transferred more easily from the fitting 15 to the collecting surface 18, the diameter of the opening roller 3 should be relatively small. As a result of this, the centrifugal forces acting on the single fibers 17 become greater, so that the single fibers 17 leave the fitting 15 faster.

The sealing insert 21 in the inside of the transport roller 4 can be regulated in such a way that if necessary the position of the collecting line 24 can be altered to a certain extent. In adaption to various staple lengths, the point in time at which the single fibers 17 are taken up by the suctioned collecting surface 18 can also be hereby regulated. For a better sealing, the feed table 10 can follow the curvature of the transport roller 4.

It is practical when the flow of air to the transport roller 4 can be regulated (not shown). In the case of too much air, the fiber beard 14 starts to flutter, whereas with too little air, the fiber beard 14 does not enter the fitting 15 of the opening roller 3 properly. To provide an additional air flow, an air inlet opening 36 is provided in the housing 38 of the spinning device, which inlet opening 36 can be regulated by a sliding valve 35. The latter mentioned air flow is directed immediately against the area of the collecting line 24 and presses the transported single fibers 17 to the collecting surface 18. A shielding 37 prevents the air flow from being directed in the wrong direction.

The housing 38 is provided with a cover 39, which can be swivelled around an axle 40 for maintenance purposes.

As can be seen from FIG. 2, the width Y of the transport roller 4 is greater than the width X of the opening roller 3. The aim is that the slivers 2 are guided so closely together before they reach the nipping line at the feed roller 1, in a way to be described below, that they can easily be opened into single fibers 17.

An open end of the slivers 2 can not only be achieved by means of high drafting of the opening roller 3, but also in that a sufficiently wide fiber veil 23 is formed. This is the so-called lateral opening, whereby the number of fibers in the width corresponds approximately to the number of fibers in the cross section of the subsequently formed yarn 30. Only at the collecting line 24 are the single fibers 17 of the fiber veil 23 guided closer together, but definitely staggered in fiber withdrawal direction F. Those single fibers 17, which land in the area of the yarn tip, are inevitably more twisted than those single fibers 17, which—seen in yarn withdrawal direction F land later on the half finished yarn. The yarn 30 is thus twisted in its core and on the outside to different degrees, whereby these differences can, however, be predetermined by the width X of the opening roller 3.

As can be seen in particular from FIG. 3, the individual slivers 2—in the present embodiment five slivers 2—are guided together before reaching the opening roller 3 in such a way that one single wide sliver 41 arises. Thus in the opening area 16 there are edge fibers only at both sides. It is known that these edge fibers are not processed well by the opening roller 3, as they are too resilient and can slip backwards. For this reason it is important to reduce accordingly the starting width of the slivers 2 by means of extended lateral guides 42 and 43 of the feed condenser 9. The guiding webs 44 located between the individual slivers 2 are thus shorter than the lateral guides 42 and 43.

Ring guides 45 are provided in front of the feed condenser 9, which serve to bring slivers 2 taken from cans, some standing further away from each other, into a suitable position.

The following is a numerical example:

It is supposed that the feed roller 1 feeds the slivers 2 at a speed of 1 m per minute, and the opening roller 3 has a circumference rotational speed of 20 m per second. A single fiber 17, which has just left the fiber beard 14, is supposed to have a speed of 4, 5 m per second. Due to the rotational speed of the transport roller 4, the single fibers 17 can reach the area of the collecting line 24 at a speed of about 8,5 m per second. If the corresponding yarn 30 is withdrawn in arrow direction F at a speed of approximately 10 m per second, that is at a speed of approximately 600 m per minute, the single fibers 17 will be constantly accelerated during the entire spinning process.

In the embodiments according to FIGS. 4 and 5 to be described in the following, the same reference numbers are used for the same components. In the case of components with the same function but of a different construction, the number of the relevant patent figure is placed before the reference numbers according to FIGS. 1 to 3, for example a 4 or a 5.

Figure 4:
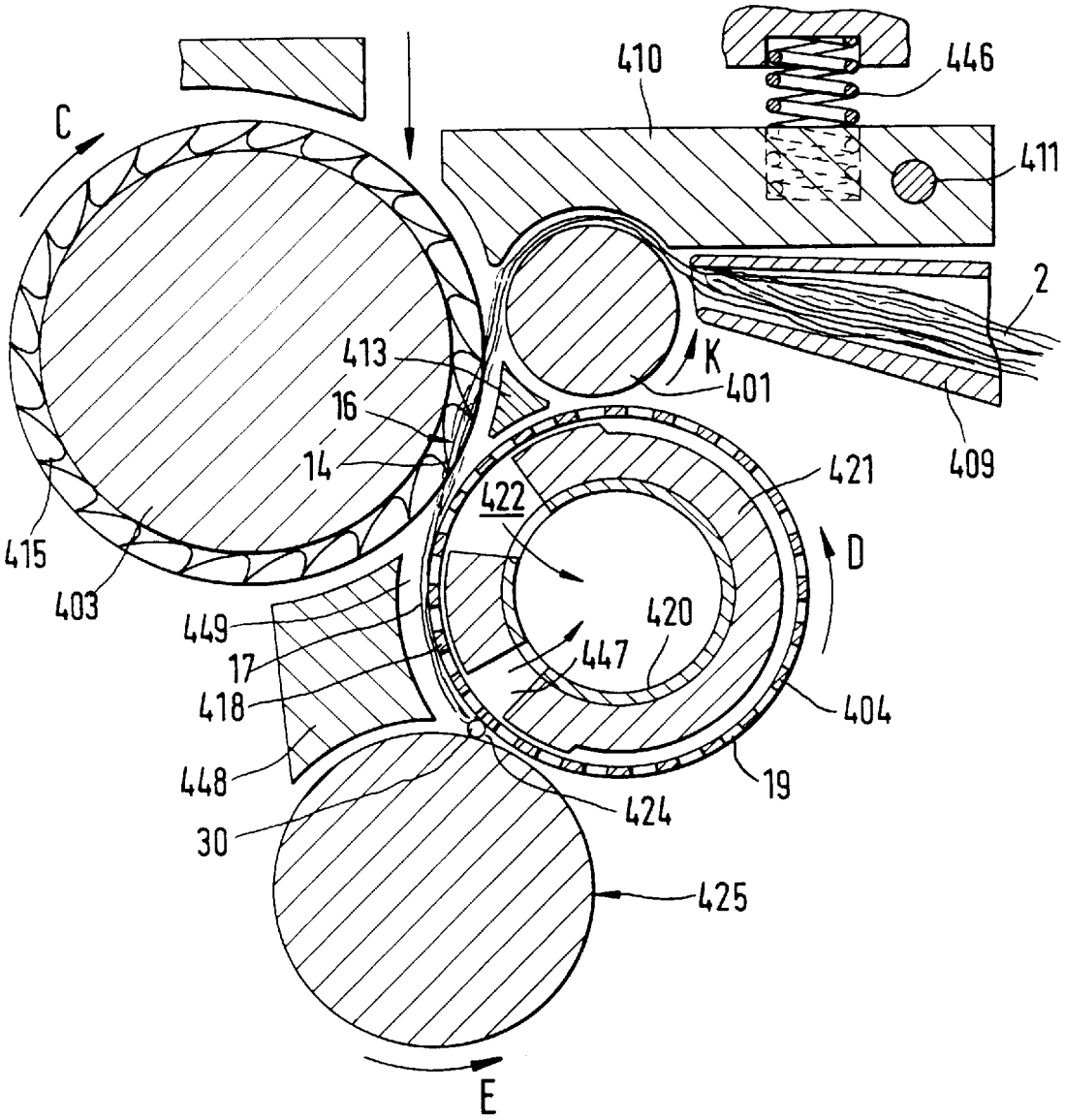
FIG. 4 is a view similar to FIG. 1, showing another preferred embodiment wherein, instead of the suctioned friction roller, a non-suctioned friction roller is provided.

In the embodiment shown in FIG. 4 a feed roller 401 is provided, which, however, runs in a rotational direction K, which is the opposite direction to the rotational direction A of FIG. 1. The device further comprises an opening roller 403, a transport roller 404 and a friction roller 425, all of whose rotational directions according to the arrow directions C,D and E are the same as those in FIG. 1.

In the embodiment shown in FIG. 4, the feed table 410 is located—in contrast to FIG. 1—above the feed roller 401. The feed table 410 is pressed against the feed roller 401 by a weighing spring 446. The slivers 2 are fed through a very wide feed condenser 409 provided with guiding webs to the nipping line between the feed roller 401 and the feed table 410. The latter can be swivelled around a swivel axle 411.

A stationary fiber beard support 413 is arranged downstream of the feed roller 401, which fiber beard support 413 supports the fiber beard 14 in the opening area 16 from behind. The fitting 415 of the opening roller 403 takes the form in the present embodiment of a standard saw tooth fitting.

Parallel to the axis of the opening roller 403, there is again a transport roller 404, whose peripheral surface in the form of a collecting surface 418 is also provided with a perforation 19. The transport roller 404 is supported on a suction tube 420. The sealing insert 421 located in the inside of the transport roller 404 leaves two suction openings 422 and 447 free, of which one is located in the opening area 16 and the other in the area of the collecting line 424.

Between the opening area 16 and the collecting line 424, the transport roller 404 is not suctioned at a small area on the periphery surface. In this area, a slide piece 448 is arranged to the collecting surface 418, which fits against the contour of the collecting surface 418 and which forms with these a short, curved channel 449. The single fibers 17 thus have the chance to slide a bit onto the collecting surface 418, but are however controlled by the transport roller 404 with respect to their arrival speed at the collecting line 424.

The friction roller 425 is, in the present invention, in the form of a closed roller which is not provided with a suctioned circumferential surface. It can be a roller provided with a rubber coating. This roller is arranged at a preferably adjustable distance from the collecting surface 418 and takes a more or less large part in imparting a twist.

In the embodiment in FIG. 5, there is again a feed roller 501, an opening roller 503, a transport roller 504 and a friction roller 525. The rotational directions A,C,D and E correspond to those in FIG. 1.

A feed table 510 is again arranged to the feed roller 501, while a wide feed condenser 509 is disposed on the feed table 510. A stationary fiber beard support 513 is again located between the feed roller 501 and the opening roller 503. The transport roller 504 is again in the form of a suction roller and supported on a suction tube 520, on which a sealing insert 521 is arranged. There is a large suction opening 522 located between the opening area 16 and the collecting line 524, so that the opened fibers 17 rest on the collecting surface 518 of the transport roller 504.

In the present embodiment, the friction roller 525 is also provided with a perforation 26 and supported on a suction tube 527. The sealing insert 528 leaves a suction slit 529 free which is directed against the collecting line 524.

In the area of the collecting surface 518, before reaching the collecting line 524, a guiding roller 550 is located, which is preferably driven by the transport roller 504 in arrow direction L. The guiding roller 550 is a rubber roller and has lateral driving collars which lie on the peripheral surface of transport roller 504 for the purpose of driving. In the area where the single fibers 17 are located, the guiding roller 550 comprises a guiding gap 551, so that the single fibers 17 are not nipped. The guiding gap 551 is of such dimensions that the single fibers 17 are forced to lie against the transport roller 504.

The opening roller 503 comprises a perforated ring 553, which is air permeable. This ring 553 runs on a non-rotating base body which is provided with a wide connecting channel 554. This connecting channel 554 is directed against the guiding gap 551.

Air can permeate through the opening roller 503 through the connecting channel 554. The air flow is effected by the suction draught of the suction tube 520, but can also be aided by pressurized air in a way not shown here. The purpose of the air flow is to release the single fibers 17 from the fitting 515 of the opening roller 503 as soon as possible so that they are taken up by the collecting surface 518 before they are accelerated too much.

Figure 5:
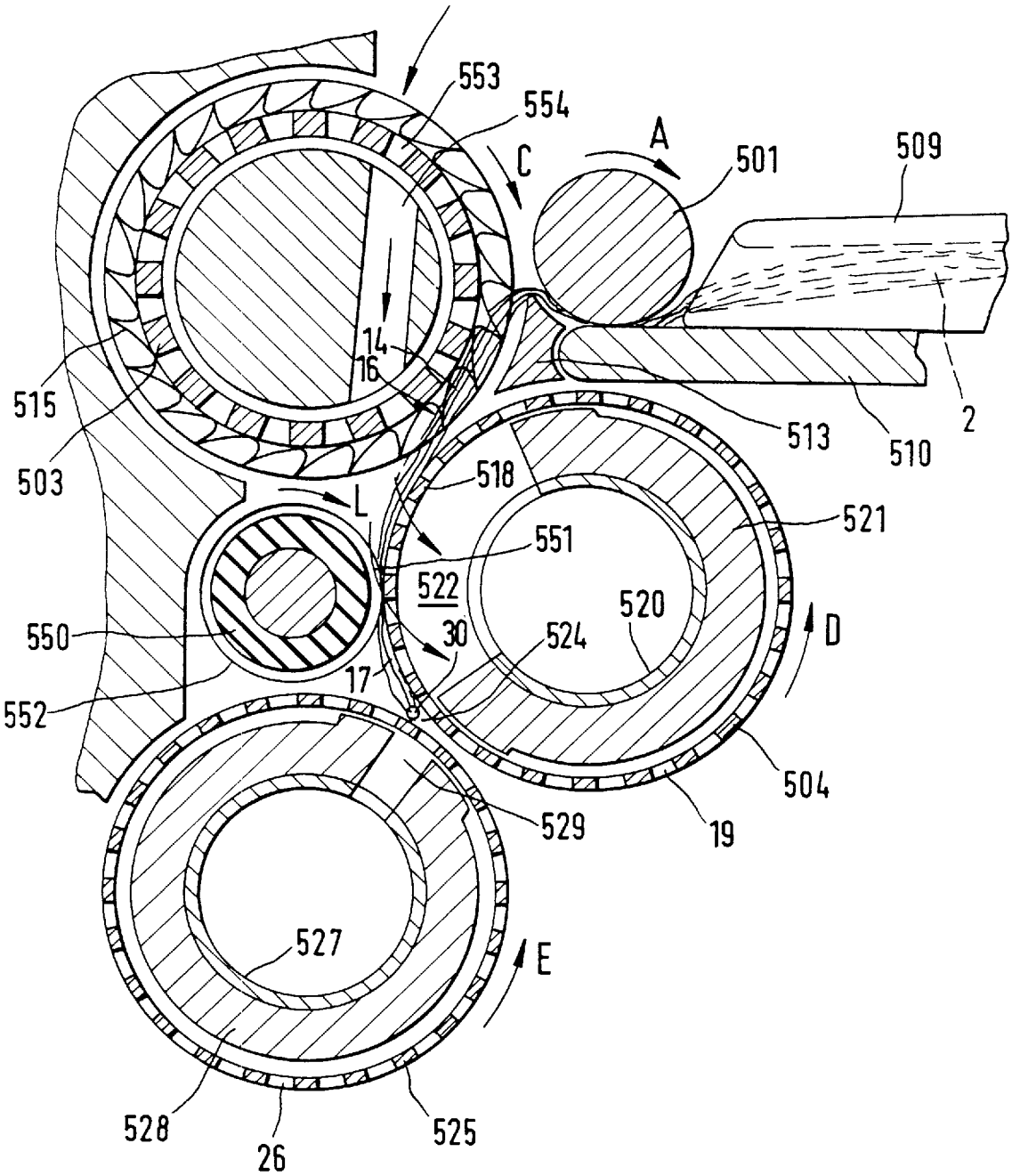
FIG. 5 is a view similar to FIG. 1, showing another preferred embodiment, wherein a guiding roller is arranged to the suction roller and whereby the opening roller is permeated by a flow of air.

It is to be understood that in the embodiments according to FIGS. 1 and 5, the individual aggregates, should, insofar as is possible, be exchangeable. For example, the opening roller 3 can be used not only for the embodiments according to FIGS. 1 to 3, but also for those in FIGS. 4 and 5. The same applies to the opening rollers 403 and 503, which can be used in the other embodiments.

In particular it should be possible to exchange the suctioned friction rollers 25 and 525 for the non-suctioned friction roller 425 and vice versa. If desired, the friction rollers 25, 425 and 525 can be omitted completely. The guide roller 550 can also be applied to the embodiments according to FIGS. 1 to 4 as required.

Essential is that the single fibers 17 are not slowed down at any point and that a transport roller 4, 404 or 504 is placed near to the opening area 16 of an opening roller 3, 403 or 503. A fiber veil 23 should form on the collecting surface 18, 418 or 518, and the yarn withdrawal should take place transversely to the circumferential direction D of the relevant transport roller 4, 404 or 504.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of making yarn using an open end spinning process comprising:

opening at least one fiber sliver to single fibers using moving opening structure with formation of a fiber beard from which individual fibers are released and transported in a transport direction, taking up said fibers on a collecting surface of a moving collecting structure disposed immediately adjacent said opening structure at a position where said fibers leave the fiber beard and while travelling at a relatively low speed with respect to the speed of the opening structure, moving the collecting surface at a higher speed than the speed of the arriving fibers with formation of a fiber veil expanded transversely to a fiber transport direction of said collecting surface whereby said fibers extend essentially parallel to each other, withdrawing said fiber veil from the collecting surface at a speed at least corresponding to the speed of the fibers leaving the fiber beard and arriving at the collecting surface, and applying a twist to said fiber veil being withdrawn.

2. The method according to claim 1, wherein said moving opening structure is an opening roller and said collecting structure is a transport roller.

3. A method according to claim 2, wherein said opening roller and transport roller have parallel rotational axes.

4. A method according to claim 3, wherein said transport roller is provided with an internal suction device facing the area where the arriving fibers impact.

5. A method according to claim 4, wherein the travel path of the fibers along the opening roller is less than 90° of the circumference of the opening roller.

6. An apparatus for open end spinning of yarn comprising:

an opener having moving opening structure for opening at least one fiber sliver to single fibers in an opening area thereby forming a fiber beard from which individual fibers are released and transported in a transport direction, a collecting surface on a moving collecting structure disposed immediately adjacent the opening area for taking up said fibers immediately after leaving the fiber beard and while travelling at a relatively low speed with respect to the speed of the opening structure, wherein the collecting surface is moving at a higher speed than the speed of the arriving fibers with formation of a fiber veil expanded transversely to a fiber transport direction of said collecting surface whereby said fibers extend essentially parallel to each other, a withdrawal device for withdrawing said fiber veil from the collecting surface at a speed at least corresponding to the speed of the fibers leaving the fiber beard and arriving at the collecting surface, and a twisting device for applying twist to said fiber veil being withdrawn.

7. The apparatus according to claim 6, wherein said moving opening structure is an opening roller and said collecting structure is a transport roller.

8. The apparatus according to claim 7, wherein said opening roller and transport roller have parallel rotational axes.

9. The apparatus according to claim 8, wherein said transport roller is provided with an internal suction device facing the area where the arriving fibers impact.

10. The apparatus according to claim 9, wherein the travel path of the fibers along the opening roller is less than 90° of the circumference of the opening roller.

* * * * *